US009284670B2

(12) United States Patent
Schwarzberger

(10) Patent No.: US 9,284,670 B2
(45) Date of Patent: Mar. 15, 2016

(54) QUILTED PATTERN INPUT DIGITIZING FRAME

(71) Applicant: ABM International, Inc., The Woodlands, TX (US)

(72) Inventor: Neal A Schwarzberger, The Woodlands, TX (US)

(73) Assignee: ABM International, Inc., The Woodlands, TX (US)

( * ) Notice: Subject to any disclaimer, the term of this patent is extended or adjusted under 35 U.S.C. 154(b) by 0 days.

(21) Appl. No.: 14/477,211

(22) Filed: Sep. 4, 2014

(65) Prior Publication Data

US 2015/0040812 A1 Feb. 12, 2015

Related U.S. Application Data

(62) Division of application No. 13/960,445, filed on Aug. 6, 2013, now Pat. No. 9,010,259.

(51) Int. Cl.

| | |
|---|---|
| ***D05B 19/14*** | (2006.01) |
| ***D05B 11/00*** | (2006.01) |
| ***D05B 19/08*** | (2006.01) |

(52) U.S. Cl.

CPC ..... *D05B 19/14* (2013.01); *D05B 11/00* (2013.01); *D05B 19/08* (2013.01)

(58) Field of Classification Search

CPC ..... D05B 3/04; D05B 3/243; D05B 11/00; D05B 19/02; D05B 19/04; D05B 19/08; D05B 19/12; D05B 19/16; D05B 19/14; D05C 3/00; G05B 2219/45195; G05B 2219/45196; D05D 2303/00; D05D 2303/02; D05D 2303/12; D05D 2303/16

See application file for complete search history.

(56) References Cited

U.S. PATENT DOCUMENTS

| | | | | |
|---|---|---|---|---|
| 4,622,907 | A | 11/1986 | Kimura | |
| 4,953,483 | A | 9/1990 | Brower et al. | |
| 5,005,500 | A | 4/1991 | Kato et al. | |
| 5,095,835 | A | 3/1992 | Jernigan et al. | |
| 5,323,722 | A | 6/1994 | Goto et al. | |
| 6,990,914 | B2 | 1/2006 | Canan | |
| 7,373,891 | B2 | 5/2008 | Koerner | |
| 8,074,590 | B2 | 12/2011 | Bentley | |
| 8,240,262 | B2 | 8/2012 | Zeiger et al. | |
| 9,010,259 | B2 * | 4/2015 | Schwarzberger | D05B 11/00 112/117 |
| 9,074,309 | B1 * | 7/2015 | Schwarzberger | D05C 7/08 |
| 2005/0145149 | A1 * | 7/2005 | Hooke | D05B 69/18 112/315 |
| 2005/0174412 | A1 * | 8/2005 | Codos | B41J 2/01 347/102 |

(Continued)

OTHER PUBLICATIONS

Innova: AutoPilot™ Computerized Quilting System (2 pages) website: http://innovalongarm.com/index.php?option=com_content&view=article&id . . . (printed Nov. 30, 2012).

(Continued)

*Primary Examiner* — Ismael Izaguirre

(74) *Attorney, Agent, or Firm* — Timothy W. Menasco, Esq.; Harter Secrest & Emery LLP

(57) ABSTRACT

A digitizer is operably coupled to a quilting machine controller, wherein an operator can input free hand or traced patterns for regulating operation of a sewing head. The digitizer can be an X-Y encoder wherein the encoder includes a transparent or translucent sensing zone which provides for the operator to input a pattern while simultaneously viewing a portion of a textile, which can itself include a pattern.

20 Claims, 2 Drawing Sheets

(56) References Cited

U.S. PATENT DOCUMENTS

| | | | | |
|---|---|---|---|---|
| 2006/0112866 | A1* | 6/2006 | Pfeifer | D05B 11/00 112/117 |
| 2006/0213417 | A1 | 9/2006 | Codos et al. | |
| 2013/0160309 | A1* | 6/2013 | Logan et al. | G01B 11/00 33/228 |

OTHER PUBLICATIONS

Innova: Navigator (2 pages) website: http://innovalongarm.com/index.php?option=com_content&view=article&id . . . (printed Nov. 30, 2012).

Innova: PantoVision™ (1 page) website: http://innovalongarm.com/index.php?option=com_content&view=article&id . . . (printed Nov. 30, 2012).

Innova: Innova® Longarm Quilting Systems—Machines (3 pages) website: http://innovalongarm.com/index_php?option=com_content&view=article&id . . . (printed Nov. 30, 2012).

Quilting Assistant.com (1 page) website: http://quiltingassistant.com/sewingmachine.html (printed Nov. 30, 2012).

Touchscreen—Wikipedia (12 pages) http://en.wikipedia.org/wiki/Touch_screen (printed Nov. 30, 2012).

Keytec, Inc. catalog document (6 pages) Nov. 30, 2012.

Bernette® for Bernina catalog document (75 pages) Nov. 30, 2012.

Magic Touch User's Manual (8 pages) Jul. 16, 2014.

* cited by examiner

QUILTED PATTERN INPUT DIGITIZING FRAME

FIELD OF THE INVENTION

The present disclosure generally relates to input and control of quilting machines, and more particularly to an X-Y encoder selectively locatable adjacent to a portion of material on a quilting machine, and more particularly to an X-Y encoder having a transparent sensing zone.

DESCRIPTION OF RELATED ART

While quilting has traditionally been a manually intensive activity, there are numerous computer controlled systems for forming stitches in a fabric. These computer controlled systems can impart elaborate stitching patterns to a fabric.

For fabric bearing a pattern or having previously applied appliques, it is important to align the fabric with the computer controlled system. That is, while the computer controlled system can provide accurate and reproducible stitching, such accuracy is of little value if the stitching is not located in the intended place.

In computer controlled systems, an operator moves the sewing head to a multiplicity of locations relative to the fabric and initiates a read of the location to create a corresponding multiplicity of reference points. However, this process is time consuming and again labor intensive. In addition, the large number of generated reference points leads to errors as the inputting process is not error free.

Therefore, the need exists for a system and method of aligning preexisting patterns with a computer controlled system. The need also exists for inputting existing patterns of, or on, a fabric into the computer controlled system, so that the computer controlled system can cooperatively impart the computer controlled stitching to the fabric. A further need exists for accommodating different quilt blocks within a given quilt.

BRIEF SUMMARY OF THE INVENTION

In one configuration, the present system provides an apparatus having a quilting machine with a workpiece retention area and a sewing head moveable relative to the workpiece retention area, the sewing head configured to form a plurality of stitches; a controller controlling movement of the sewing head relative to the workpiece retention area; and an X-Y encoder positionable adjacent to a portion of the workpiece retention area, the X-Y encoder operably connected to the controller.

It is contemplated the X-Y encoder is movable between a first position adjacent to the portion of the workpiece retention area and a second position spaced from the portion of the workpiece retention area. The X-Y encoder can include a transparent or translucent sensing zone, in which motion or the presence of an indicator is converted into an electronic signal. The transparent or translucent sensing zone can be surrounded or supported by a rigid frame.

A method is provided including the steps of locating a transparent sensing zone of an X-Y encoder adjacent to a portion of a textile retained on a support frame of a quilting machine having a sewing head, the portion of the textile being visible within the sensing zone; creating a pattern within the sensing zone of the encoder relative to the portion of the textile visible through the sensing zone; and transferring an output of the X-Y encoder to a controller operably connected to the X-Y controller and the quilting machine.

In another configuration, a sewing head of the sewing machine is moved in a given path relative to the created pattern, wherein the given path is one of a fill, a mask, the created pattern or an offset pattern having a predetermined offset distance from the detected pattern. The method can include moving the X-Y encoder to a position spaced from the portion of the textile and forming a plurality of stitches A further method includes implementing controller driven operation of a sewing head of a quilting machine relative to a workpiece retained on a support frame, the operation corresponding to at least a portion of a pattern created within a transparent sensing zone of an X-Y encoder adjacent to the retained workpiece.

BRIEF DESCRIPTION OF THE SEVERAL VIEWS OF THE DRAWING(S)

DETAILED DESCRIPTION OF THE INVENTION

Figure 1:
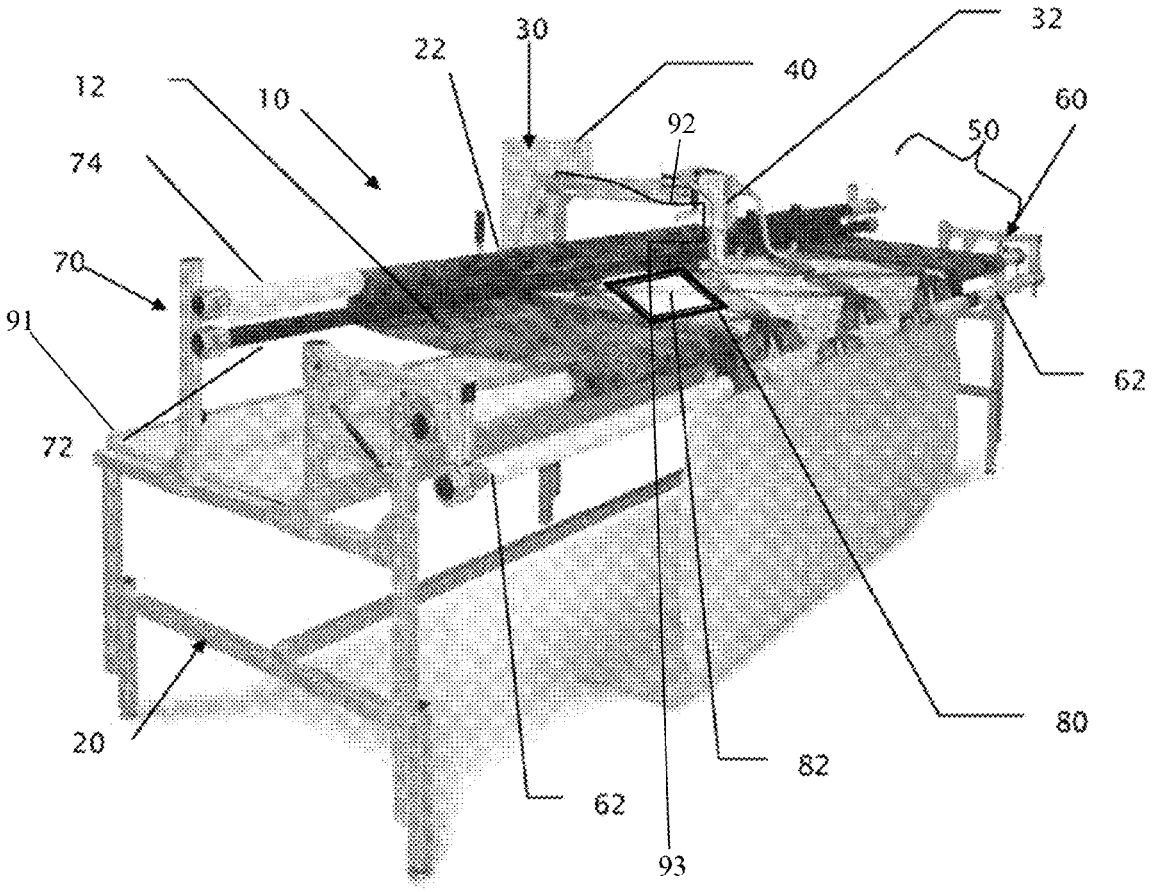
FIG. 1 is a perspective view of a first configuration of a quilting machine for inputting a pattern into a computer controlled system by using an X-Y encoder having a transparent sensing zone.

Referring to FIG. 1, the present system cooperates with a computer controllable quilting machine 10 to impart stitching at given locations on a textile 12.

Although the present description is set forth in terms of a given quilting machine 10, the system is not limited to the particular configuration of the quilting machine.

The term quilting machine 10 encompasses any device for stitching or embroidery of a textile 12 such as but not limited to machine using digitized patterns with commercially available embroidery software, wherein different types of "fills" can be used to add texture and/or design to the workpiece. The term includes quilting machines 10 for stitching together multiple layers, such as a filler layer between a top and a bottom textile layer, as well as an embroidery machine.

The quilting machine 10 includes a main frame 20, a sewing machine 30, a support frame 50 for supporting or retaining a textile and an X-Y encoder 80. In one configuration of the quilting machine 10, the support frame 50 includes a supply roll assembly 60 and a take up roll assembly 70 which cooperate to define a workpiece retention area 76.

In selected configurations, the quilting machine 10 further includes a controller 40 operably connected to the sewing machine 30 and the X-Y encoder 80. The controller 40 includes a processor (or computer), a memory, display and input, such as touch screen, keyboard, key pad and/or mouse. The controller 40 can be physically connected to the main frame or the sewing machine 30. Alternatively, the controller 40 can be a stand-alone device which communicates with the sewing machine 30 and the X-Y encoder 80 though a wired or wireless connection.

The controller 40 can control or regulate operation of the sewing machine 30 as known in the art, such as with respect to stitching and patterns. In addition, the controller 40 includes or accesses programs for functions including generating, inputting or manipulating patterns. The programs for manipulating the patterns can include line smoothing functions as known in the art and found in Adobe Photoshop program, Xara Xtreme, Artrage, Manga Studio, GIMP or OpenCanvas.

The term textile 12 encompasses any article of manufacture or fabric made by weaving, felting, knitting, crocheting, compressing natural or synthetic fibers. In one configuration, the textile 12 is a quilt. In construction of a quilt it is common to refer to or identify quilt blocks. A quilt block is a small part of a quilt top. A number of quilt blocks together make a quilt. The blocks can be the same, or different from each other. Quilt blocks can be pieced or appliquéd or represent a given portion of the quilt.

The main frame 20 forms a stand or base for supporting the sewing machine 30, the support frame 50, the X-Y encoder 80 and typically the controller 40. The main frame 20 can have any of a variety of configurations, such as shown in FIGS. 1-2.

Figure 2:
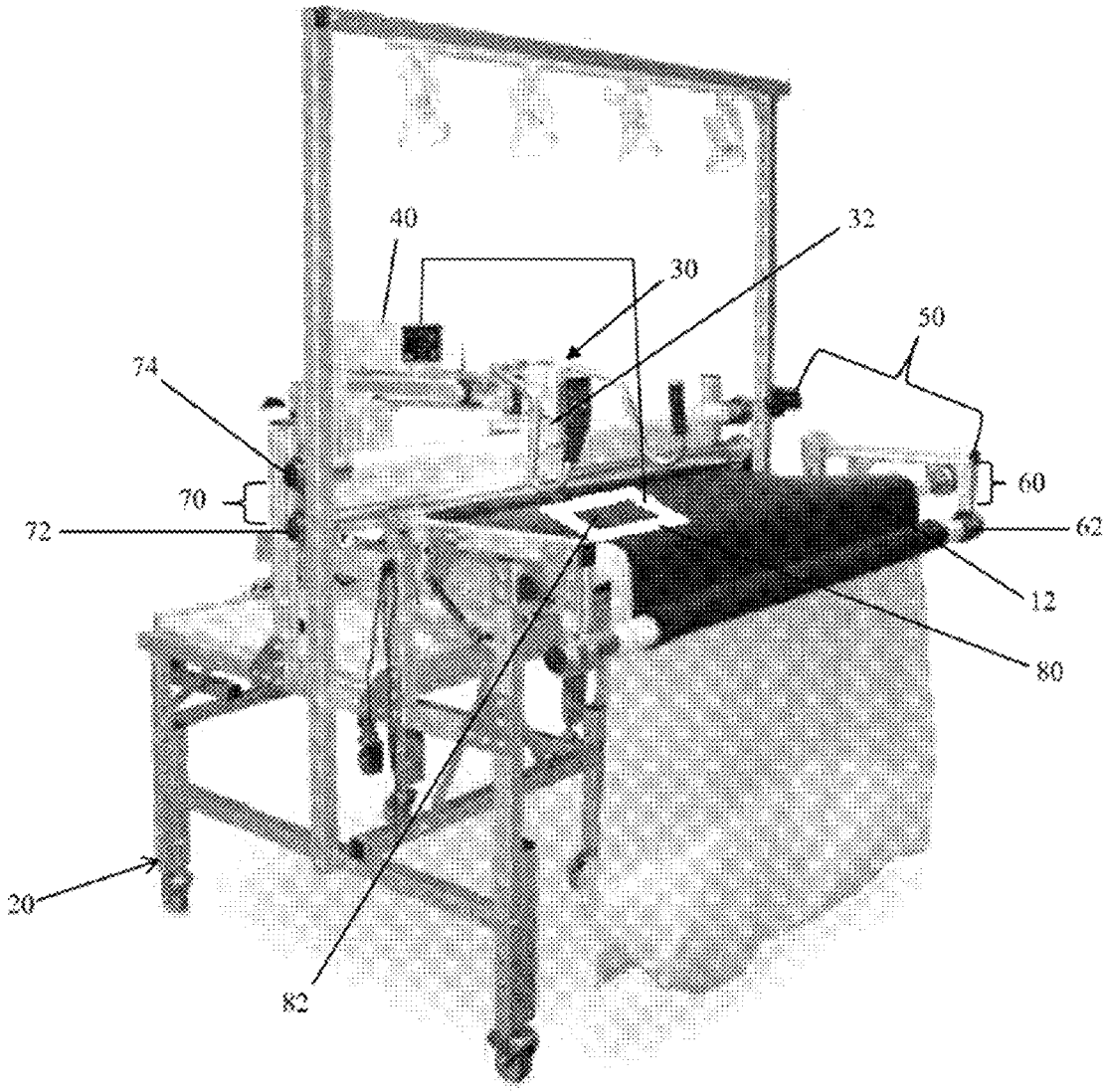
FIG. 2 is a perspective view of a second configuration of a quilting machine for inputting a pattern into a computer controlled system by using an X-Y encoder having a transparent sensing zone.

Referring to FIG. 2, a carriage 22 interconnects the main frame 20 to the sewing machine 30. The interconnection includes a plurality of rollers or slides which permit movement of the sewing machine 30 relative to the textile 12 in the X and Y directions. For purposes of description, the X direction is taken as extending parallel to take-up and supply rollers and the Y direction is perpendicular to the X direction and thus is parallel to the direction along which the textile is wound and unwound.

The interconnection of the carriage 22 and the main frame 20 includes motion sensors such as wheels, rollers or rotation counters, or electrical eyes and markings for providing positioning data to the controller 40. As well known in the art, the motion sensors allow the controller 40 to "know" the position of the sewing machine 30 relative to the support frame 50 (or at least a predetermined reference point or fiducial). Thus, the carriage 22 can be an encoder carriage providing location data to the controller 40.

Although the present description is set forth in terms of a sewing machine 30 that is moved during stitching relative to a portion of the textile 12 (or workpiece), it is understood the textile (workpiece) can be moved relative to a fixed sewing machine, as is known in the art. Alternatively, both the sewing machine 30 and the textile 12 can be simultaneously moved.

The sewing machine 30 includes a sewing head 32, typically having a portion above the plane of the workpiece retention area 76 and a second portion below the plane of the workpiece retention area, thereby providing for passage of a portion of a needle through the textile and selective engaging and passage of a length of thread through the textile 12.

The support frame 50 provides the textile retention area 76 that retains the textile 12 or portion of the textile relative to the main frame 20 and relative to the sewing machine 30. The support frame 50 includes the supply roll assembly 60 and the take roll assembly 70.

The supply roll assembly 60 retains an initial length of textile wound about a supply roller 62. For systems employing a plurality of layers, such quilting having a liner, a filling and a top layer, there may be three supply rollers in the supply roll assembly 60. One of the supply rollers 62 is set such that a portion of the periphery defines a line in a plane of operation of the sewing machine 30.

The take up roller assembly 70 includes a bed roller 72 having a portion of the periphery generally coplanar with a portion of the periphery of the supply roller and a take up roller 74 for winding the stitched textile.

The support frame 50 functions to retain a portion of the textile 12 (the workpiece) between the line of contact with one of the supply rollers 62 and the bed roller 72 or take up roller 74, if the take up roller compensates for changing diameter of the winding). The supply roll assembly 60 and the take up roll assembly 70 create a tension within the textile 12 between the two assemblies, thereby disposing the intermediate textile in a substantially planar orientation and defining the workpiece retention area 76.

The X-Y encoder 80 encompasses digitizing tablets such as frames, digitizer frames, glass digitizers, touch screens, touch screen digitizers. In one configuration, the X-Y encoder 80 has a sensing zone 82 (the area which translations a position into a corresponding signal) that is transparent or at least translucent. Thus, transparent touch screens or projection touch screens are configurations of the X-Y encoder 80. Commercially available X-Y encoders 80 include products by Keytec, Inc. of Garland, Tex. Suitable products of Keytec include OPTIR touch or Magic Touch.

The X-Y encoder 80 can be located adjacent a portion of the textile 12 retained by the support frame 50, thus within the workpiece retention area 76, such that the underlying textile is viewable through the transparent sensing zone 82. The X-Y encoder 80 is operably connected to the controller 40. The connection can be wired or wireless as known in the art.

In one configuration, the X-Y encoder 80 is moveably connected to the main frame 20 or the sewing machine 30 to be moveable between a first position adjacent to the textile 12 within the workpiece retention area 76 and a second position spaced from the textile 12 (and operation of the sewing machine) and the workpiece retention area 76.

Depending on the specific construction of the X-Y encoder 80, an encoder carriage 90 can operably connect the main frame 20 and the X-Y encoder, wherein the X-Y encoder can move relative to the main frame. The encoder carriage 90 can be affixed to a track or rails 91 for movement or to an articulated arm 92 for position relative to the textile or a quilt block. The encoder carriage can include motion sensors such as wheel, rollers or rotation counters, or electrical eyes and markings for providing positioning data to the controller 40. As well known in the art, the motion sensors allow the controller 40 to "know" the position of the encoder carriage 90 (or the X-Y encoder 80) relative to the support frame 50 (or at least a predetermined reference point or fiducial). Thus, the encoder carriage 90 can provide location data to the controller 40.

In operation, the X-Y encoder 80 is located adjacent the portion of the textile 12 that is retained on the support frame 50. The operator can view a portion of the textile 12 through the sensing zone 82 of the X-Y encoder 80.

In one configuration, a portion or point of the X-Y encoder 80 is registered with a given reference point or fiducial (or with the position of the sewing head 32) which is known or input to the controller 40 and thus each available point within the sensing zone 82 is registerable relative to the encoder carriage 90 (or the X-Y encoder 80) and the sewing machine 30 (and usually the sewing head 32).

The operator can then input a pattern (create a digitized pattern), such as tracing an applique previously applied to the textile 12 or an existing pattern on the textile, such as one formed by prior stitching or woven into the design of the textile. The operator can use a finger, pointer 93, or other indicator within the sensing zone to be read by the X-Y encoder 80. As the portion of the textile 12 in the workpiece retention area 76 is visible through the visible sensing zone 82, the operator can uniquely adapt or align the patter being input or created relative to the actual textile and existing patterns of the textile.

Thus, the present system provides for a correspondence of an actual quilt block and a digitized pattern, wherein the quilt block may include variances from true or perfect geometry. As the quilt block is visible through the transparent sensing zone 82, the pattern to be imparted to the textile 12 can be accurately aligned with any actual variances within the textile.

The digitized pattern is sent from the X-Y encoder 80 to the controller 40. The provided digitized pattern inherently includes reference points linking portion of the retained textile 12, the existing pattern and the input (or created) pattern.

Once the periphery or area has been traced on the X-Y encoder 80 and provided to the controller 40, the controller can instruct the sewing machine 30 to form stitches in the textile 12, such as in a fill, a pattern, a line or any other configuration relative to the digitized pattern, or affixing (stitching) an applique.

Further, the digitized pattern could be a setback from the actual periphery of an applique on the textile 12. That is, the operator could create a pattern in the sensing zone 82 that represents a setback or offset from a periphery of an applique or design visible through the sensing zone. The controller 40 can then direct the sewing head 32 to stitch along the created setback line, thereby providing for an intended fray between the setback line of stitching and the edge of the applique.

Thus, the present system provides an operator to efficiently creates a digitized pattern that can be a mask a region of the textile 12, wherein the masked region can be filled on either the outside or inside, as well as a first pattern on the inside of the region and a second pattern on the outside of the masked region.

Further, the X-Y encoder 80 can be used to input a digitized pattern, wherein the operator can use the digitized pattern in the controller 40, by displaying the pattern on the monitor or display of the controller. Thus, the operator can overlay the input pattern with an existing pattern to remove or replace the existing pattern on the inside or the outside of the input pattern.

The X-Y encoder 80 can be used to "teach" a pattern to the controller 80, wherein the input pattern can be saved by the controller and used on a current textile 12 or a future textile. Then, by virtue of the controller 40, the input pattern can be increased or decreased in size. Further, the input pattern can be smoothed, skewed or stretched.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. An apparatus comprising:

(a) a quilting machine having a workpiece retention area and a sewing head moveable relative to the workpiece retention area, the sewing head configured to form a plurality of stitches;

(b) a controller controlling movement of the sewing head relative to the workpiece retention area;

(c) an encoder carriage, the encoder carriage moveable over the workpiece retention area, the encoder carriage having a sensing zone, the encoder carriage operably connected to the controller to transmit a position of the encoder carriage, and wherein the encoder carriage comprises an articulated arm moveable over the workpiece retention area; and (d) a display operably coupled to the controller for displaying a pattern created in the encoder carriage sensing zone.

2. The apparatus according to claim 1, wherein the encoder carriage comprises a pointer fixedly coupled to the encoder carriage, the pointer moveable over the workpiece retention area.

3. The apparatus according to claim 2, wherein the encoder carriage with an encoder is able to create a digitized representation of a workpiece pattern.

4. The apparatus according to claim 1, wherein the encoder carriage comprises a track for movement of the encoder carriage over the workpiece retention area.

5. The apparatus according to claim 4, wherein the encoder carriage comprises at least one sensor able to sense a position of the encoder carriage, the at least one sensor able to communicate the position of the encoder carriage to the controller.

6. The apparatus according to claim 1, wherein the sensing zone is transparent or translucent, a portion of the workpiece retention area visible within the transparent or translucent sensing zone.

7. A method comprising:

(a) locating a sensing zone of an encoder carriage within a workpiece retention area retained on a support frame of a quilting machine having a sewing head;

(b) creating a pattern within the sensing zone of the encoder carriage relative to the workpiece retention area;

(c) transmitting an output of the encoder carriage to a controller operably connected to the encoder carriage and the quilting machine, and wherein the encoder carriage comprises an articulated arm moveable over the workpiece retention area; and (d) displaying the created pattern on a display associated with the quilting machine.

8. The method according to claim 7, wherein the encoder carriage further comprises a pointer fixedly coupled to the encoder carriage, the pointer moveable over the workpiece retention area.

9. The method according to claim 8, wherein the encoder carriage comprises at least one sensor able to sense a position of the encoder carriage, the at least one sensor able to communicate the position of the encoder carriage to the controller.

10. The method according to claim 9, the method further comprising moving a sewing head of the quilting machine in a given path relative to the created pattern.

11. The method according to claim 10, wherein the given path is one of a fill, a mask, the created pattern or an offset pattern having a predetermined offset distance from the detected pattern.

12. The method according to claim 8, wherein the encoder carriage with an encoder is able to create a digitized representation of a workpiece pattern.

13. The method according to claim 7, wherein the encoder carriage comprises a track for movement of the encoder carriage over the workpiece retention area.

14. The method according to claim 7, wherein the sensing zone is transparent or translucent.

15. A non-transitory computer-readable medium tangibly comprising computer program instructions which when executed on a processor of an apparatus causes the apparatus to at least:

(a) locate a sensing zone of an encoder carriage within a workpiece retention area retained on a support frame of a quilting machine having a sewing head;

(b) create a pattern within the sensing zone of the encoder carriage relative to the workpiece retention area;

(c) transmit an output of the encoder carriage to a controller operably connected to the encoder carriage and the quilting machine, wherein the encoder carriage comprises an articulated arm moveable over the workpiece retention area; and (d) display the pattern on a display associated with the quilting machine.

16. The non-transitory computer-readable medium according to claim 15, the encoder carriage further comprises a pointer fixedly coupled to the encoder carriage, the pointer moveable over the workpiece retention area.

17. The non-transitory computer-readable medium according to claim 16, wherein the encoder carriage comprises at least one sensor able to sense a position of the encoder carriage, the at least one sensor able to communicate the position of the encoder carriage to the controller.

18. The non-transitory computer-readable medium according to claim 17, the computer program instructions with the processor further cause the apparatus to move the sewing head of the quilting machine in a given path relative to the created pattern.

19. The non-transitory computer-readable medium according to claim 18, wherein the given path is one of a fill, a mask, the created pattern or an offset pattern having a predetermined offset distance from the detected pattern.

20. The non-transitory computer-readable medium according to claim 15, wherein the encoder carriage comprises a track for movement of the encoder carriage over the workpiece retention area.

* * * * *